US008898852B2

(12) United States Patent
Manninen et al.

(10) Patent No.: US 8,898,852 B2
(45) Date of Patent: Dec. 2, 2014

(54) AIR BURST TO CLEAR DETECTION WINDOW

(75) Inventors: Keijo Manninen, Varkaus (FI); Teemu Matilainen, Leppakaarre (FI); James Haza, Duluth, GA (US)

(73) Assignee: Honeywell International Inc., Morristown, NJ (US)

( * ) Notice: Subject to any disclaimer, the term of this patent is extended or adjusted under 35 U.S.C. 154(b) by 375 days.

(21) Appl. No.: 12/850,072

(22) Filed: Aug. 4, 2010

(65) Prior Publication Data

US 2012/0030901 A1 Feb. 9, 2012

(51) Int. Cl.
*A47L 5/00* (2006.01)
*B08B 5/02* (2006.01)

(52) U.S. Cl.
CPC ..... *B08B 5/02* (2013.01)
USPC ..... 15/301; 15/250.01

(58) Field of Classification Search
USPC ..... 15/300.1, 301, 314, 316.1, 322, 324, 15/344, 404–405, 415.1, 419; 134/18
See application file for complete search history.

(56) References Cited

U.S. PATENT DOCUMENTS 1,491,866 A * 4/1924 Kissling et al. ..... 362/480
5,546,630 A * 8/1996 Long ..... 15/313
6,722,397 B2 * 4/2004 Few ..... 141/65
6,883,251 B2 * 4/2005 Terrell et al. ..... 34/527
6,904,704 B2 * 6/2005 Morris et al. ..... 34/666
7,040,328 B2 * 5/2006 Woodard ..... 134/95.2
7,140,740 B1 * 11/2006 Cooper ..... 359/509
8,087,122 B2 * 1/2012 Martin ..... 15/250.002
2005/0051193 A1 * 3/2005 Duke ..... 134/17
2005/0123334 A1 6/2005 Corso et al. ..... 400/585
2006/0289036 A1 * 12/2006 Hilton ..... 134/22.11
2007/0183771 A1 8/2007 Takanashi et al. ..... 396/429
2008/0120864 A1 5/2008 Clarke et al. ..... 34/85
2008/0184679 A1 8/2008 Jirele et al. ..... 55/283
2009/0056067 A1 * 3/2009 Wen et al. ..... 15/405
2009/0201413 A1 8/2009 Fishman ..... 348/373
2009/0250533 A1 * 10/2009 Akiyama et al. ..... 239/284.1
2010/0096471 A1 * 4/2010 Djordjic ..... 239/67

* cited by examiner

*Primary Examiner* — Brian Glessner
*Assistant Examiner* — Beth Stephan
(74) *Attorney, Agent, or Firm* — Kermit D. Lopez; Luis M. Ortiz; Ortiz & Lopez, PLLC

(57) ABSTRACT

An apparatus including a housing having at least one window, an air burst nozzle positioned atop the housing and aimed at the window, a compressed air source, an air control solenoid connected to the air burst nozzle, the compressed air source, and a support box. The compressed air source provides compressed air to the air control solenoid. A timer module directs a magnetic valve of the support box to supply power to the coil of the air control solenoid in order to engage the solenoid. When the air control solenoid is engaged, compressed air is provided to the air burst nozzle. The air burst nozzle directs a burst of air at the window of the housing to clear it of any particulates. In accordance with user programming of the timer module, the process is then repeated at regular intervals.

13 Claims, 3 Drawing Sheets

AIR BURST TO CLEAR DETECTION WINDOW

TECHNICAL FIELD

Embodiments are generally related to optical measuring and monitoring applications. Embodiments are further related to systems and methods for clearing particulates from a surface.

BACKGROUND OF THE INVENTION

Optical measuring and monitoring applications generally require a window from the detection apparatus to the measurement/monitoring target. In addition, optical monitoring/measuring requires sufficient lighting to function properly. Particularly in process environments, the window and light source are susceptible to becoming obscured when dust, moisture, and other contaminants collect on the window and light the surface of the source. A dirty window or light source, for example, can gradually affect the measurement/monitoring results and, ultimately, block the view and light with respect to the measurement/monitoring target. Thus, optical measuring/monitoring devices and systems require periodic manual cleaning, which is expensive and, in some cases, difficult or impossible to arrange.

Tissue manufacturing machines utilized in optical/monitoring applications, for example, present some unique challenges with respect to maintaining a clear sharp picture and optimal lighting due to the amount of fiber dust generated by the machine in normal operation. A number of approaches to solve this problem currently exist, including wiper blades, moving windows, air knives, pinholes or water sprays, or combinations of methods to clear the window and light source of debris.

Each of the aforementioned methods has distinct drawbacks. For example, a disadvantage of wiper blades and water sprays is that such components can block a user's view for a short period of time, thus preventing proper measurement/monitoring. Additionally, a washing system that utilizes water can exacerbate the situation by transforming the fiber dust into a paste that can then accumulate, and eventually require extensive cleaning. Moving windows (e.g. rotating window) utilize multiple moving parts, which require periodic maintenance. A pinhole, utilized in the context of tissue manufacturing machines, is typically configured as a small hole without a window, which requires highly specific and costly pinhole optics. Additionally, air knives typically generate turbulent airflow, which does not fully protect the window from particulate accumulation.

The standard air knife can be successful in keeping a majority of the dust away from the lens or window, but due to static charge build-up on the glass and dead area under the wipe, eventually dust does build up and obscures the view. Therefore, it is believed that a need exists for a highly effective system and method to periodically clear debris from a window or light source with minimal interference or downtime.

BRIEF SUMMARY

The following summary is provided to facilitate an understanding of some of the innovative features unique to the disclosed embodiment and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved measuring and monitoring apparatus, system, and method.

It is another aspect of the disclosed embodiments to provide for improved systems and methods for clearing particulates from a surface.

The aforementioned aspects and other objects can now be achieved as described herein. An apparatus is disclosed, which includes a housing having one or more windows, and an air burst nozzle positioned atop the housing and aimed at the window. Additionally, a compressed air source and an air control solenoid are operably connected to the air burst nozzle, the compressed air source, and a support box, wherein the air control solenoid regulates flow of compressed air to the air burst nozzle in order to clear particulates from the window (s).

Additionally, a compressed air source can provide compressed air to an air control solenoid. A timer module directs a magnetic valve of a support box to supply power to the coil of the air control solenoid in order to engage the solenoid. When the air control solenoid is engaged, compressed air is provided to an air burst nozzle. The air burst nozzle directs a burst of air at a window of a housing to clear it of any particulates. In accordance with user programming of the timer module, the process can then be repeated at regular intervals or upon user demand. In an alternative embodiment, an air knife nozzle can be configured and utilized to prevent accumulation of particulates on the window.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

It is to be understood by persons of ordinary skill in the art that the following descriptions are provided for purposes of illustration and not for limitation. An artisan understands that there are many variations that lie within the spirit of the invention and the scope of the appended claims. Unnecessary detail of known functions and operations may be omitted from the current description so as not to obscure the present invention.

Figure 1:
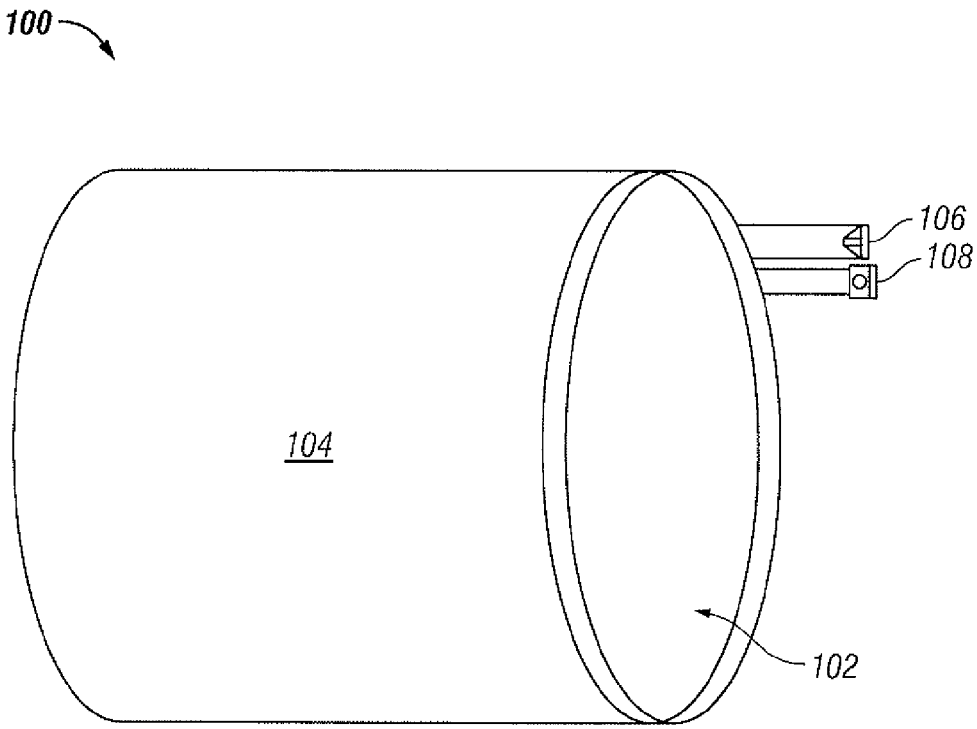
FIG. 1 illustrates a front view of an apparatus for deploying a burst of air to clear particulates from a surface, in accordance with the disclosed embodiments.

FIG. 1 illustrates a front view of an apparatus 100 for deploying a burst of air to clear particulates from a surface, in accordance with the disclosed embodiments. The apparatus 100 includes a housing 104 having a window 102 through which an optical sensing device (not shown) can "view" a monitoring/measuring target. A lighting device may also be positioned within the housing 104 such that light is directed out from behind the window to illuminate the area being monitored/measured. The housing 104 protects the optical sensing/lighting device from environmental conditions, while the window 102 provides a uniform surface over which an air knife created by an air knife nozzle 108 can be employed to aid in keeping the window 102 clear of debris. An airburst nozzle 106 can also be provided to direct bursts of compressed air onto the window 102 to periodically clear debris and maintain optimal viewing and lighting. Note that in FIGS. 1-3 herein, identical or similar parts or elements are generally indicated by identical reference numerals.

Figure 2:
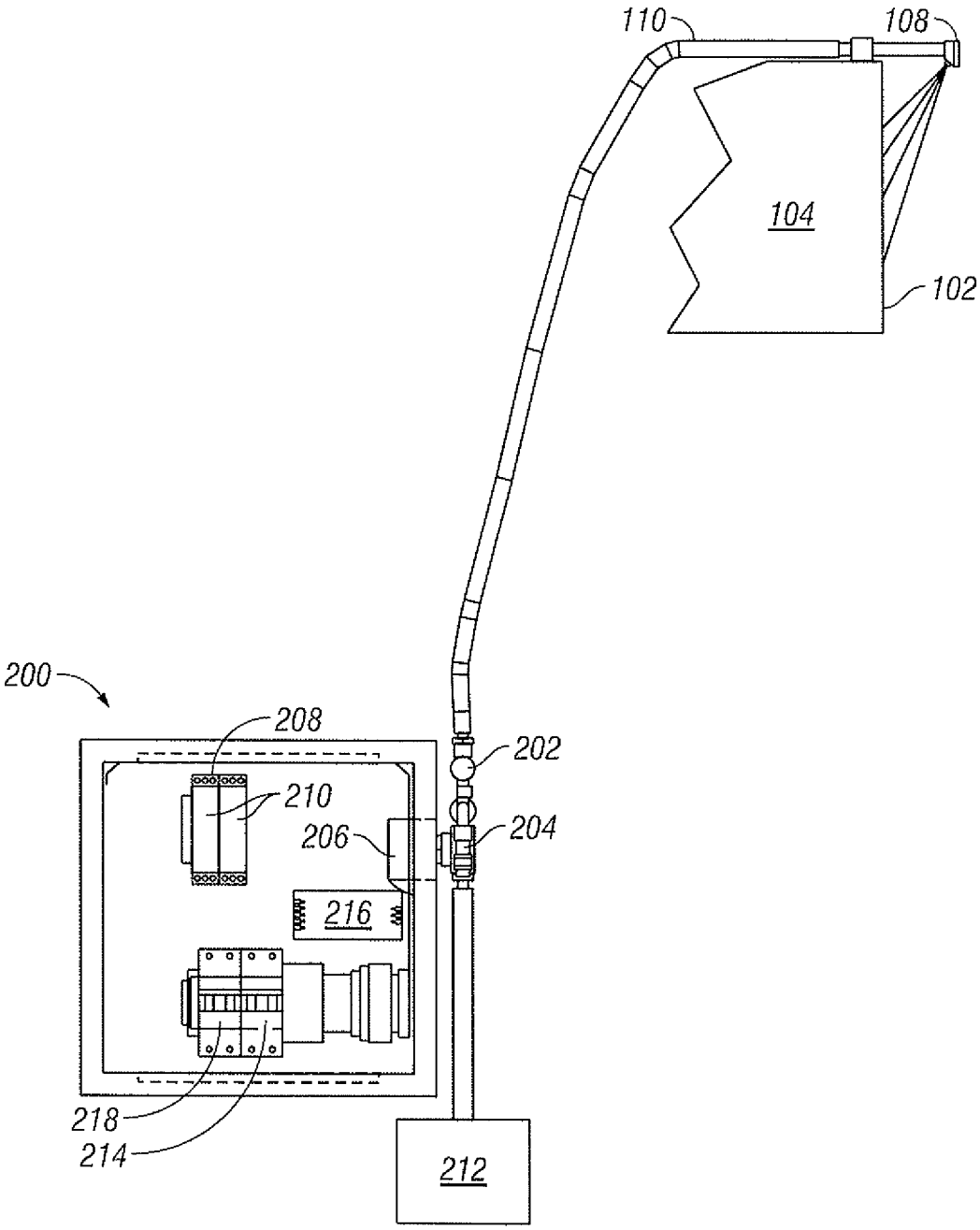
FIG. 2 illustrates a top view of the apparatus including a support box for regulating the air bursts, in accordance with the disclosed embodiments.

FIG. 2 illustrates the top view of the apparatus 100 including a support box 200 for regulating the air bursts, in accordance with the disclosed embodiments. The airburst nozzle 106 can be positioned atop the housing 104 such that the burst of air from the airburst nozzle 106 can be directed at the window 102. The airburst nozzle 106 can be configured as a forty-five degree fan pattern nozzle with respect to the window 102 in order to optimize effectiveness. Tubing 110 connects the airburst nozzle 106 to a pressure switch 202 and then to an air control solenoid 204. The air control solenoid 204 is controlled by a magnetic valve 206 within the support box 200. Compressed air at 60-100 PSI is supplied by a compressed air source 212 through the tubing 110 to the air control solenoid 204. When the air control solenoid 204 engages, the compressed air is directed through the airburst nozzle 106 at the window 102 to dislodge and remove any particles in order to provide a clear view for the optical sensing device.

The support box 200 also includes a programmable timer module 208 that can be configured to include one or more or a group of time relays 210. The timer module 208 can be programmed to initiate an air burst at a reoccurring time period of anywhere from 10 min to several hours depending on the environmental conditions and the need to remove dust from the housing protective glass. The timer module 208 functions to apply power to the magnetic valve 206 which controls a coil within the solenoid 204 in order to engage the solenoid 204 to allow the compressed air through the tubing 110 to the air burst nozzle 106. The timer module 208 also allows a user to set the duration of the air bursts for 1 second up to 1 minute. Also present in the support box 200 are a fuse 214, a power input 216, and a main switch 218. It should be noted that in an alternate embodiment, the components of the support box 200 can be integrated directly into the housing 104.

Figure 3:
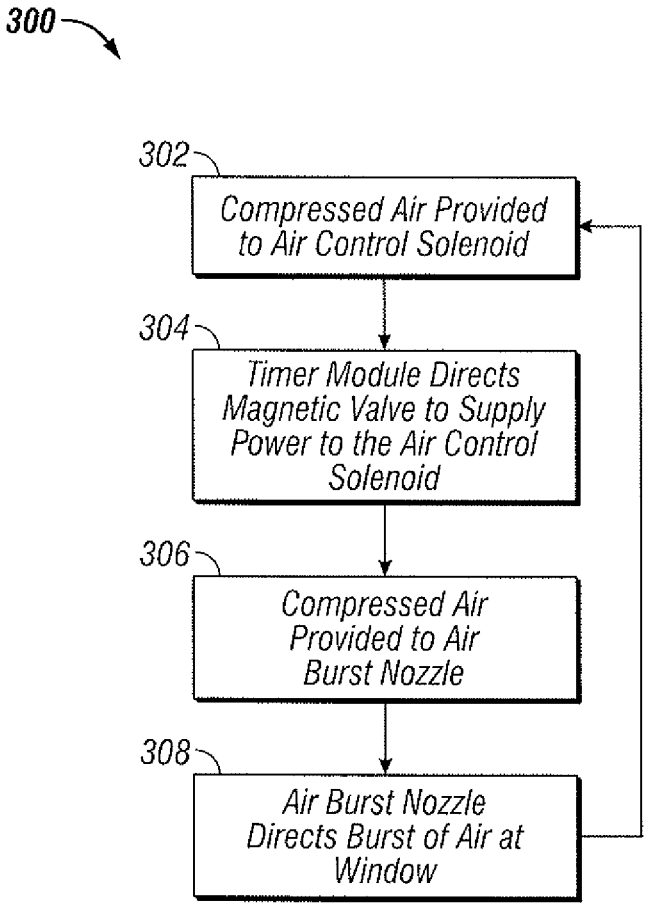
FIG. 3 illustrates a high-level flow chart indicating logical operational steps of a method for deploying a burst of air to clear particulates from a window, in accordance with the disclosed embodiments.

FIG. 3 illustrates a high-level flow chart indicating logical operational steps of a method 300 for clearing particulates from a surface utilizing the apparatus 100 of FIG. 1, in accordance with the disclosed embodiments. The compressed air source 212 provides compressed air to the air control solenoid 204, as depicted at box 302. The timer module 208 directs the magnetic valve 206 of the support box 200 to supply power to the coil of the air control solenoid 204 in order to engage the solenoid 204, as shown at box 304. When the air control solenoid 204 is engaged, compressed air is provided to the air burst nozzle 106, as shown at box 306. The air burst nozzle 106 directs a burst of air at the window 102 of the housing 104 to clear it of any particulates, as shown at box 308. In accordance with user programming of the timer module 208, the process is then repeated at regular intervals or upon user demand. In an alternate embodiment, an air knife nozzle 108 is additionally provided to prevent accumulation of particulates on the window 102.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An optical monitoring device window clearing apparatus comprising:

a housing having at least one window;

an air burst nozzle positioned on top of said housing and aimed downward at said window;

a lighting device positioned within said housing such that light is directed outward from said window to illuminate a monitoring area;

a compressed air source;

an air knife nozzle positioned proximate to said fixed position air burst nozzle;

an air control solenoid operably connected to said air burst nozzle and said compressed air source, wherein said air control solenoid regulates flow of compressed air in bursts to said air burst nozzle in order to clear particulates from said at least one window;

tubing connected to said air burst nozzle and to a pressure switch, wherein said tubing is also connected to said air control solenoid; and a support box connected to said housing and said air control solenoid, said support box comprising a magnetic valve for controlling said air control solenoid and a programmable timer module for controlling said magnetic valve.

2. The apparatus of claim 1 wherein said programmable timer module comprises a plurality of time relays.

3. The apparatus of claim 2 wherein said programmable timer module controls an initiation of an air burst at a reoccurring time period with respect to said air burst nozzle.

4. The apparatus of claim 3 wherein said programmable timer module controls the duration of said air burst.

5. The apparatus of claim 4 wherein said air burst nozzle is configured with a forty-five degree angle fan pattern nozzle.

6. A system for clearing particulates from a surface, comprising:

a housing having at least one window;

an air burst nozzle positioned on top of said housing and aimed downward at said window;

a lighting device positioned within said housing such that light is directed outward from said window to illuminate a monitoring area;

a compressed air source; and an air knife nozzle positioned proximate to said fixed position air burst nozzle;

an air control solenoid operably connected to said air burst nozzle and said compressed air source, wherein said air control solenoid regulates flow of compressed air in bursts to said air burst nozzle in order to clear particulates from said at least one window;

tubing connected to said air burst nozzle and to a pressure switch, wherein said tubing is also connected to said air control solenoid; and a support box connected to said housing and said air control solenoid, said support box comprising a magnetic valve for controlling said air control solenoid and a programmable timer module for controlling said magnetic valve.

7. The apparatus of claim 6 wherein said programmable timer module comprises a plurality of time relays.

8. The apparatus of claim 7 wherein said programmable timer module controls an initiation of an air burst at a reoccurring time period with respect to said air burst nozzle.

9. The apparatus of claim 8 wherein said programmable timer module controls the duration of said air burst.

10. The apparatus of claim 9 wherein said air burst nozzle is configured with a forty-five degree angle fan pattern nozzle.

11. A method of clearing particulates from a surface, comprising:

providing compressed air to an air control solenoid through tubing connected to an air burst nozzle and to a pressure switch;

engaging said air control solenoid to provide said compressed air to said air burst nozzle positioned on top of a housing having a window and being aimed downward at said window;

engaging said air control solenoid at regular intervals as directed by a programmable timer module;

directing a burst of air from said air burst nozzle at said window to clear it of particulates;

directing light outward from within said housing to illuminate a monitoring area.

12. The method of claim 11 wherein the duration of said burst of air is directed by said programmable timer module.

13. The method of claim 12 wherein said air burst nozzle is configured with a forty-five degree angle fan pattern nozzle.

* * * * *